US011573002B1

(12) United States Patent
Shen

(10) Patent No.: US 11,573,002 B1
(45) Date of Patent: Feb. 7, 2023

(54) LAMPSHADE AND LAMP

(71) Applicant: Rongdong Shen, Guangdong (CN)

(72) Inventor: Rongdong Shen, Guangdong (CN)

( * ) Notice: Subject to any disclaimer, the term of this patent is extended or adjusted under 35 U.S.C. 154(b) by 0 days.

(21) Appl. No.: 17/686,416

(22) Filed: Mar. 4, 2022

(30) Foreign Application Priority Data

Jan. 12, 2022 (CN) ..... 202220069649.9

(51) Int. Cl.

| | |
|---|---|
| ***F21V 1/02*** | (2006.01) |
| ***F21V 17/10*** | (2006.01) |
| ***F21V 1/14*** | (2006.01) |
| ***F21V 33/00*** | (2006.01) |
| ***F21V 21/02*** | (2006.01) |
| ***F21V 23/04*** | (2006.01) |

(52) U.S. Cl.
CPC ..... *F21V 1/02* (2013.01); *F21V 1/143* (2013.01); *F21V 17/108* (2013.01); *F21V 21/02* (2013.01); *F21V 23/04* (2013.01); *F21V 33/0012* (2013.01); *F21V 33/0052* (2013.01)

(58) Field of Classification Search
CPC ..... F21V 1/02; F21V 1/143
See application file for complete search history.

(56) References Cited

U.S. PATENT DOCUMENTS

| | | | | |
|---|---|---|---|---|
| 2,900,865 | A * | 8/1959 | Mayon | F16B 9/05 411/524 |
| 3,787,676 | A * | 1/1974 | Korach | F21V 1/06 362/352 |
| 4,212,052 | A * | 7/1980 | Chambard | F21V 17/108 362/358 |
| 5,662,412 | A * | 9/1997 | Glendmyer | F21V 1/14 362/357 |
| 9,546,770 | B2 * | 1/2017 | Wu | F21V 17/108 |
| 10,641,460 | B1 * | 5/2020 | Chen | F21V 1/143 |
| 10,883,697 | B1 * | 1/2021 | Ma | F21V 1/06 |
| 2012/0320605 | A1 * | 12/2012 | Wu | F21V 17/164 362/351 |
| 2013/0010477 | A1 * | 1/2013 | Wu | F21V 17/105 362/351 |
| 2013/0201695 | A1 * | 8/2013 | Lewis | F21V 17/002 29/458 |
| 2016/0238213 | A1 * | 8/2016 | Kimmet | F21V 1/04 |
| 2018/0010761 | A1 * | 1/2018 | Hong | F21V 1/12 |
| 2019/0056084 | A1 * | 2/2019 | Liao | F21V 1/143 |

* cited by examiner

*Primary Examiner* — Zheng Song
(74) *Attorney, Agent, or Firm* — JCIPRNET

(57) ABSTRACT

A lampshade and lamp includes a cover body and a plurality of hooks, which are respectively arranged on inner sides of upper and lower ends of the cover body. The cover body is an elongated carrier sheet that is foldable, the ends on both lateral sides of the cover body are provided with matching Velcro, and the cover body is connected in a circle through the Velcro at the ends on both lateral sides. Each hook includes an inserting piece and a spring arm. The inserting piece is vertically arranged in the cover body, and the bottom end of the inserting piece is provided with an inward extending spring arm. The spring arm includes an elastic section, a collision section and a circular arc end.

9 Claims, 11 Drawing Sheets

LAMPSHADE AND LAMP

CROSS-REFERENCE TO RELATED APPLICATION

This application claims the priority benefit of China application serial no. 202220069649.9, filed on Jan. 12, 2022. The entirety of the above-mentioned patent application is hereby incorporated by reference herein and made a part of this specification.

BACKGROUND

Technical Field

The present invention belongs to the technical field of lamps, in particular to a lampshade and lamp with less packaging and transportation volume, is beautiful and reliable and convenient assembly.

Description of Related Art

The existing upright lamps are widely used in household, but the volume is still large. Because most lampshades occupy large space during transportation, which causes the transportation cost is high and the carrying is inconvenient, and they are easy to be damaged and deformed during transportation. Moreover, the installation of lampshade is too inconvenient to meet the higher and higher requirements of industrial design and transportation. Therefore, the existing technology needs to be improved.

SUMMARY

The purpose of the present invention is to overcome the shortcomings of the prior art, provide a lampshade and lamp, improve the reliability and aesthetics of the previous products, save packaging and transportation cost, facilitate home assembly of users, and maintain the reliability and aesthetics of the lampshade.

In order to solve the existing technical problems, the present invention adopts the following technical scheme.

A lampshade, which comprises a cover body and a plurality of hooks, which are respectively arranged on the inner sides of the upper and lower ends of the cover body. The cover body is an elongated carrier sheet that can be folded, the ends on both lateral sides of the cover body are provided with matching Velcro, and the cover body is connected in a circle through the Velcro at the ends on both lateral sides. Each hook comprises an inserting piece and a spring arm, the inserting piece is vertically arranged in the cover body, and the bottom end of the inserting piece is provided with an inward extending spring arm. A width of the inserting piece is larger than that of the spring arm, and the height of the spring arm is larger than that of the inserting piece. The spring arm comprises an elastic section, a collision section and a circular arc end. The end of the spring arm connected to the inserting piece is provided with the elastic section, an end of the elastic section away from the inserting piece is connected to the collision section, and the end of the collision section away from the elastic section is provided with the circular arc end. The collision section is inclined towards the upper direction of the elastic section, and extends higher than the top of the inserting piece. The cover body comprises an outer cover layer and an inner cover layer, the inserting piece of the hook is arranged between the outer cover layer and the inner cover layer, and the inner cover layer is provided with a socket which can accommodate the spring arm of the hook extending inward and penetrating the inner cover layer. An opening of the hook faces the outer end of the cover body. The top of the cover body is provided with an upper support, and the upper support ring body is buckled in a plurality of hooks on the inner side of the top of the cover body. The bottom end of the cover body is provided with a lower support, and the lower support ring body is buckled in a plurality of hooks on the inner side of the bottom end of the cover body.

Further, the inserting piece is fixed between the outer cover layer and the inner cover layer by hot pressing. The width of the spring arm is one third of that of the inserting piece. The height of the inserting piece is half of that of the spring arm. The included angle of the projection of the inclined axis of the collision section on the vertical plane of the inserting piece is an acute angle.

Further, the upper support comprises a first upper arc ring and a second upper arc ring, the first upper arc ring and the second upper arc ring are connected with each other through a first hinge, and the first upper arc ring and the second upper arc ring are in a circle shape after extending in a plane. The first upper arc ring is provided with a first support rod and a second support rod, and the first support rod and the second support rod are inclined downward.

Further, the end of the first support rod away from the first upper arc ring is provided with a first connecting rod, and the end of the second support rod away from the first upper arc ring is provided with a second connecting rod. A first installation ring is arranged below the first upper arc ring, and the plane of the first installation ring is longitudinally parallel to the plane of the first upper arc ring. The end of the first connecting rod away from the first support rod is arranged on the first installation ring, and the end of the second connecting rod away from the second support rod is arranged on the first installation ring.

Further, the middle of the second upper arc ring is provided with a third support rod, the end of the third support rod away from the second upper arc ring is connected with the third connecting rod through the third hinge, and the end of the third connecting rod away from the third hinge is provided with a fourth connecting rod. A second installation ring is arranged in the middle of the second upper arc ring, the end of the fourth connecting rod away from the third connecting rod is arranged on the second installation ring, and the fourth connecting rod is parallel to the plane of the second installation ring.

A lamp comprises a support, on which a storage table is arranged, and the lamp also comprises the lampshade described above. The end of the storage table is provided with a storage box, the outside of the storage box is flush with the side end of the storage table, the middle of the storage box is provided with a support pipe, and the end of the support pipe away from the storage box is provided with a transversely extending telescopic rod, the end of the telescopic rod away from the support pipe is provided with a vertical lamp holder, the lamp holder is provided with a lampshade support, the lampshade support extends upward. The cover body is arranged on the outside of the lamp holder and the lampshade support. The screw at the end of the lampshade support away from the lamp holder passes through the assembly ring in the middle of the upper support, and the screw is provided with an assembly head matched therewith.

Further, the support is provided with a storage plate which is located below the storage table. The lamp holder is provided with a group of symmetrical inward ring embracing buckle pieces, the lampshade support is a strip-shaped elastic frame with two plug-in pins, the strip-shaped elastic frame of the lampshade support is gourd-shaped, the top connecting section of the lampshade support is provided with upward screws, and the ends of the two plug-in pins at the bottom of the lampshade support are respectively provided with buckle plugs matching with the buckle pieces, the buckle plugs are buckled and located in the buckle pieces.

Further, a functional base is arranged on the side of the storage box facing the storage table, the functional base is arranged on the storage table and adjacent to the storage box, and the functional base is provided with a socket, a USB kit including a larger port and a smaller port, an audio and a rocker switch.

The cover body and the support of the present invention are separately placed and packaged horizontally, which is convenient for disassembly, foldable, easy for packaging and transportation, the connection between the lampshade and the support is stable and reliable, and the lampshade matches up the hook beautifully, which can reduce the volume occupied by the lampshade during packaging, save cost and space and facilitate transportation.

DESCRIPTION OF THE EMBODIMENTS

Figure 1:
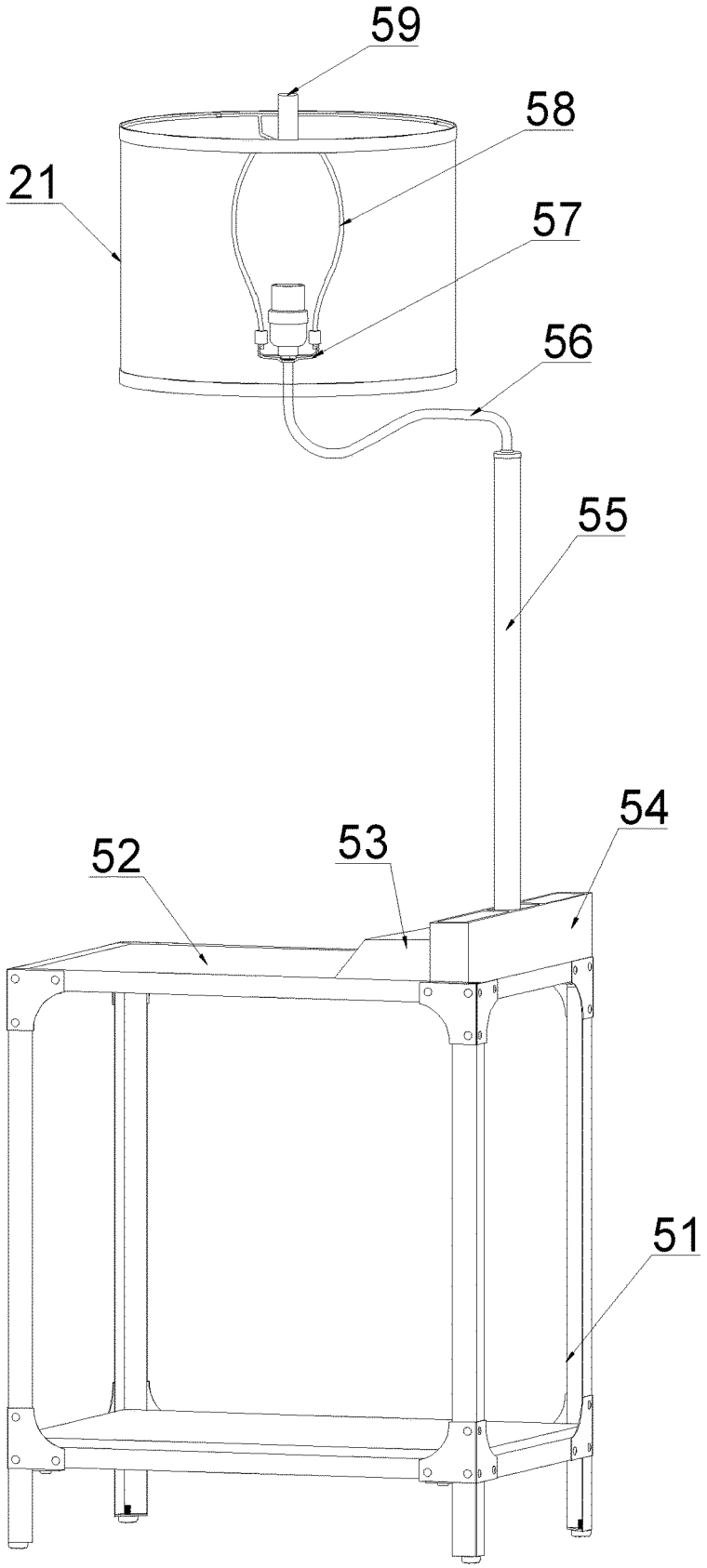
FIG. 1 is a structural diagram of the embodiment of the present invention.
Figure 2:
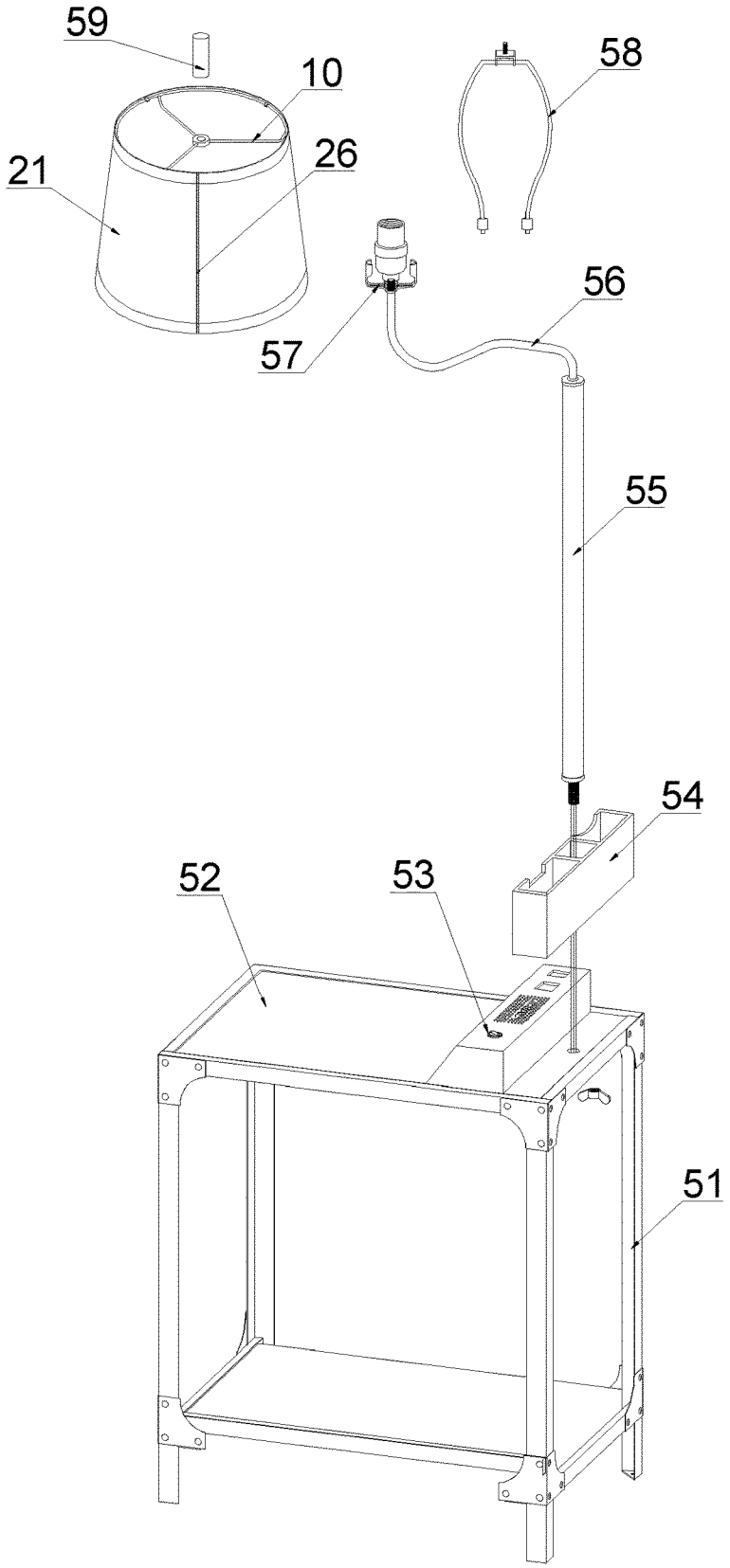
FIG. 2 is an assembly diagram of the embodiment of the present invention.
Figure 3:
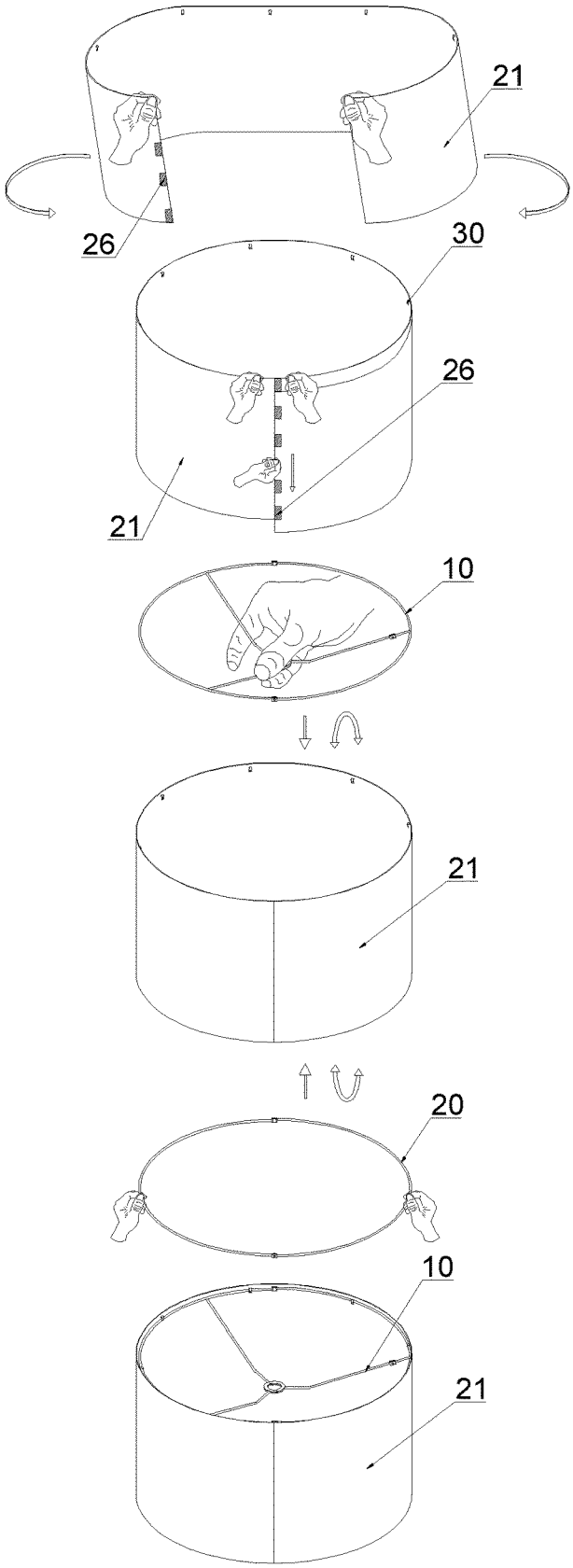
FIG. 3 is an assembly diagram of the cover body part of the embodiment of the present invention.
Figure 4:
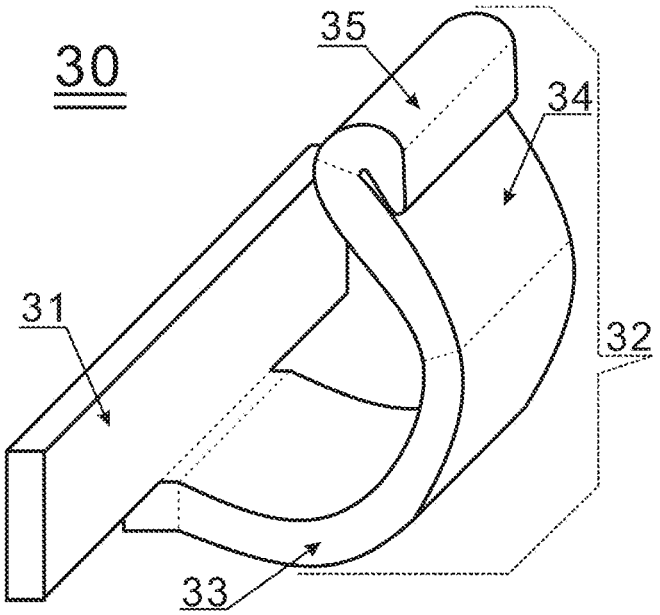
FIG. 4 is a three-dimensional schematic diagram of the hook part of the embodiment of the present invention.
Figure 5:
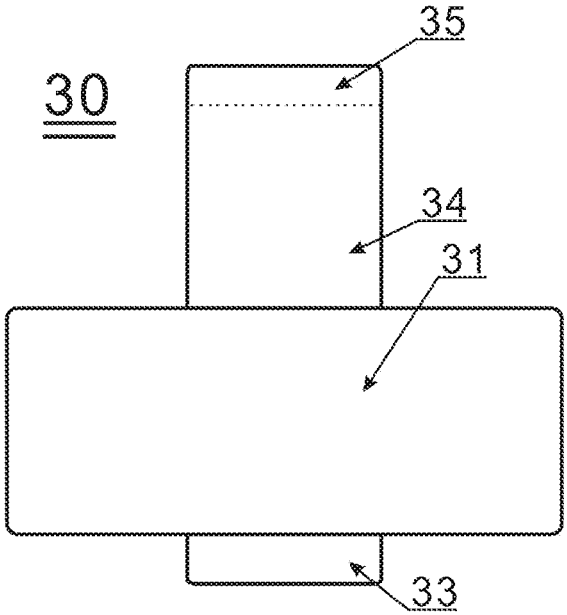
FIG. 5 is an orthographic view of the hook part of the embodiment of the present invention.
Figure 6:
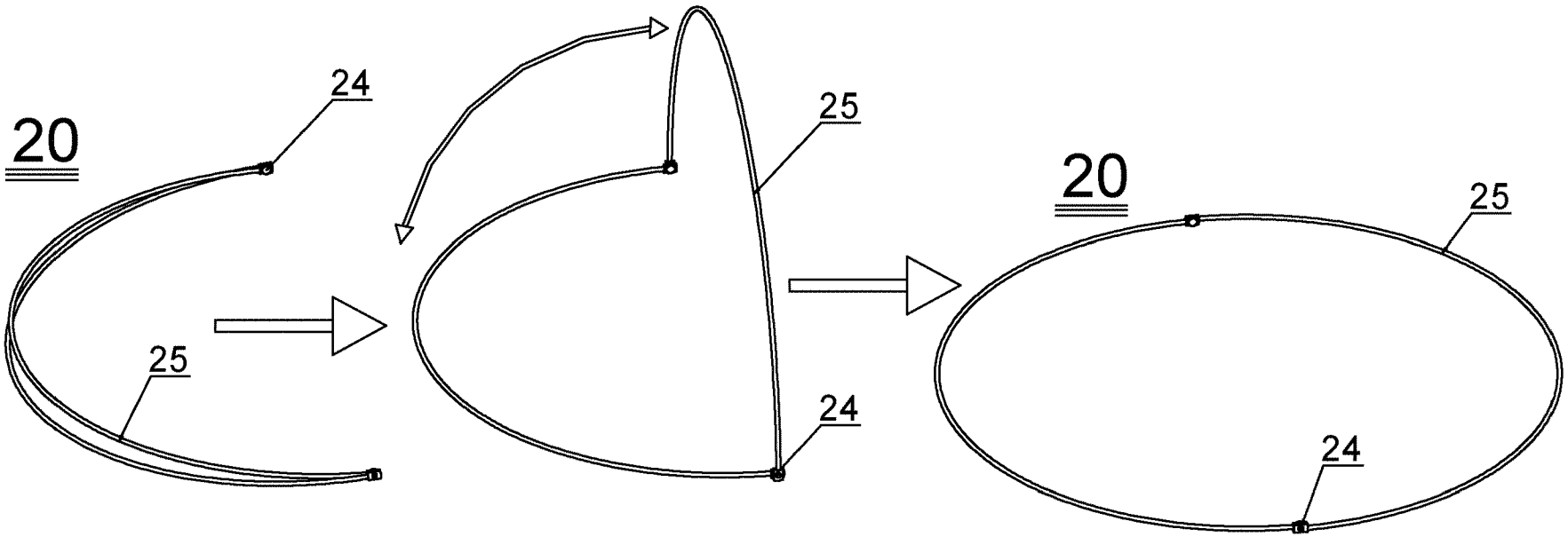
FIG. 6 is an assembly diagram of the lower support part of the embodiment of the present invention.
Figure 7:
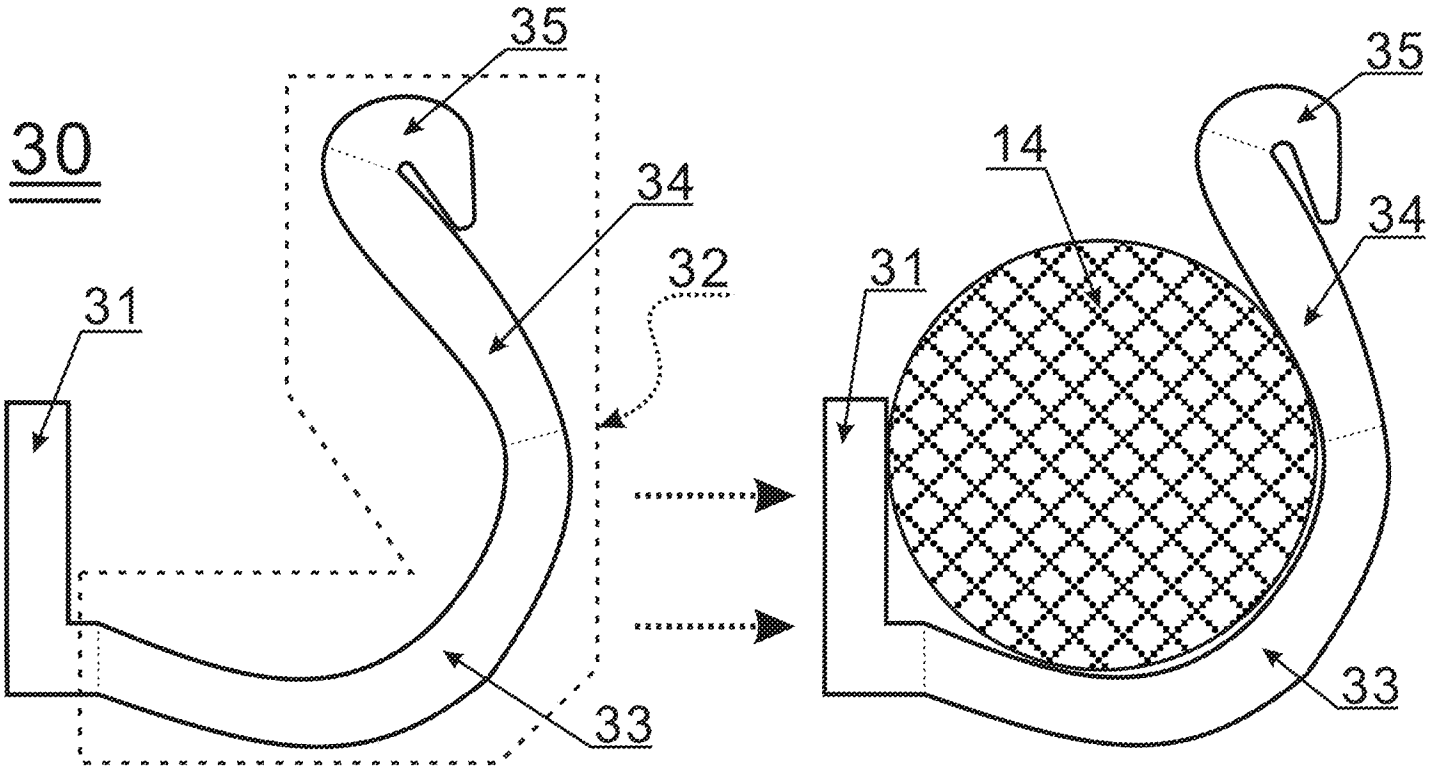
FIG. 7 is a schematic diagram of the use of the hook part of the embodiment of the present invention.
Figure 8:
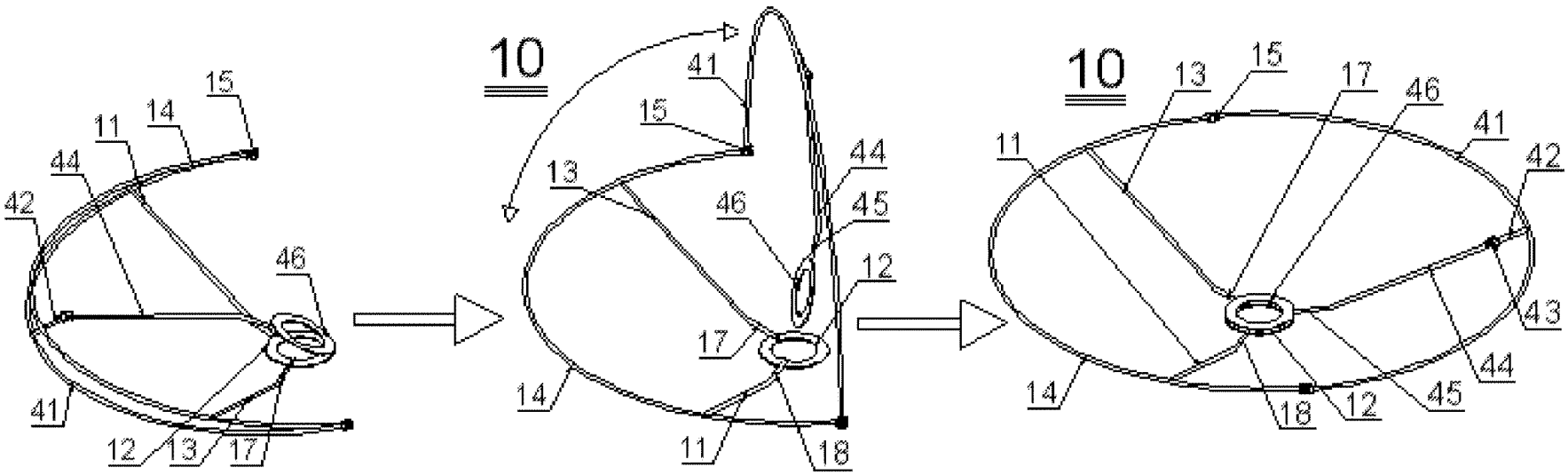
FIG. 8 is an assembly diagram of the upper support part of the embodiment of the present invention.
Figure 9:
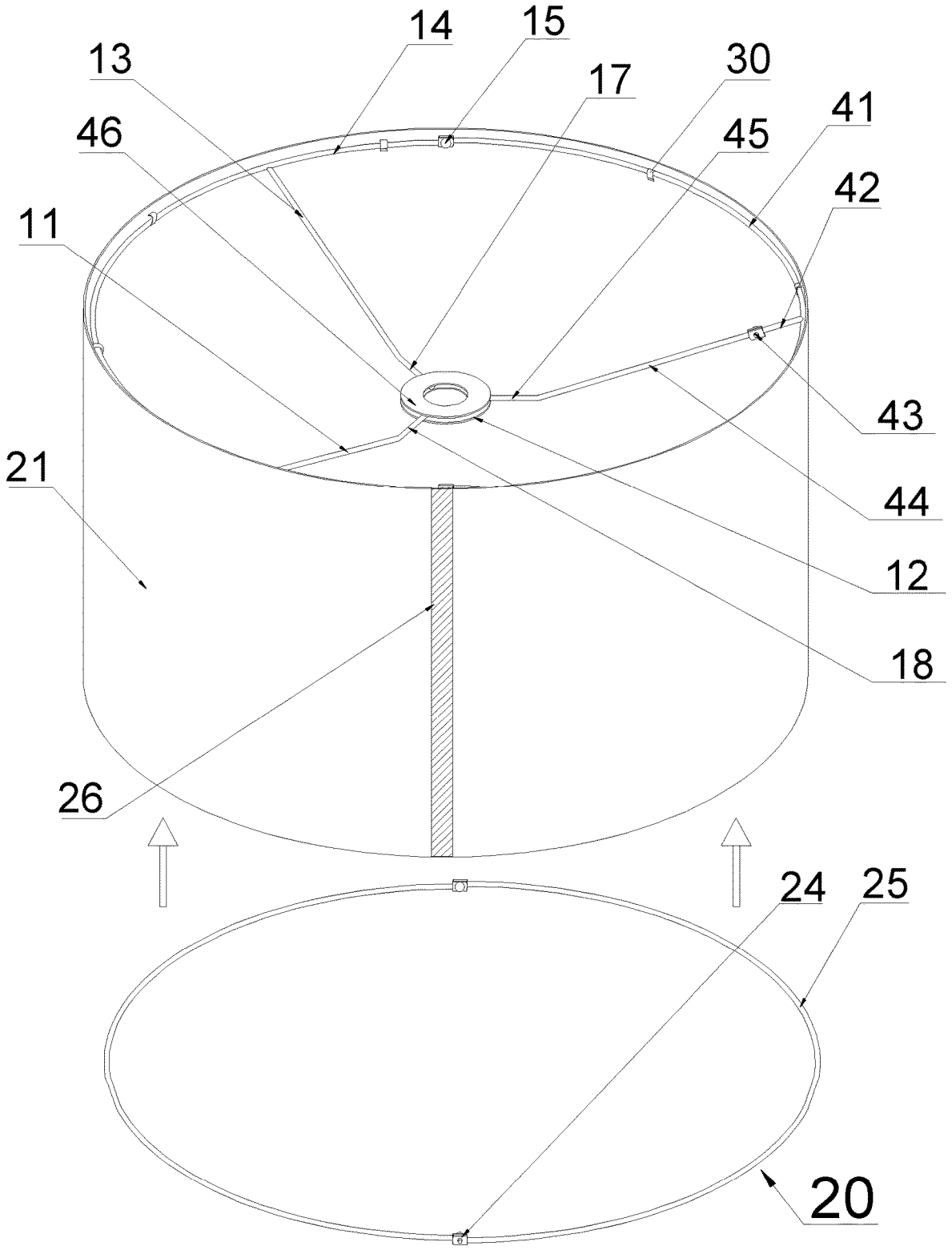
FIG. 9 is a combined schematic diagram of the cover body part of the embodiment of the present invention.
Figure 10:
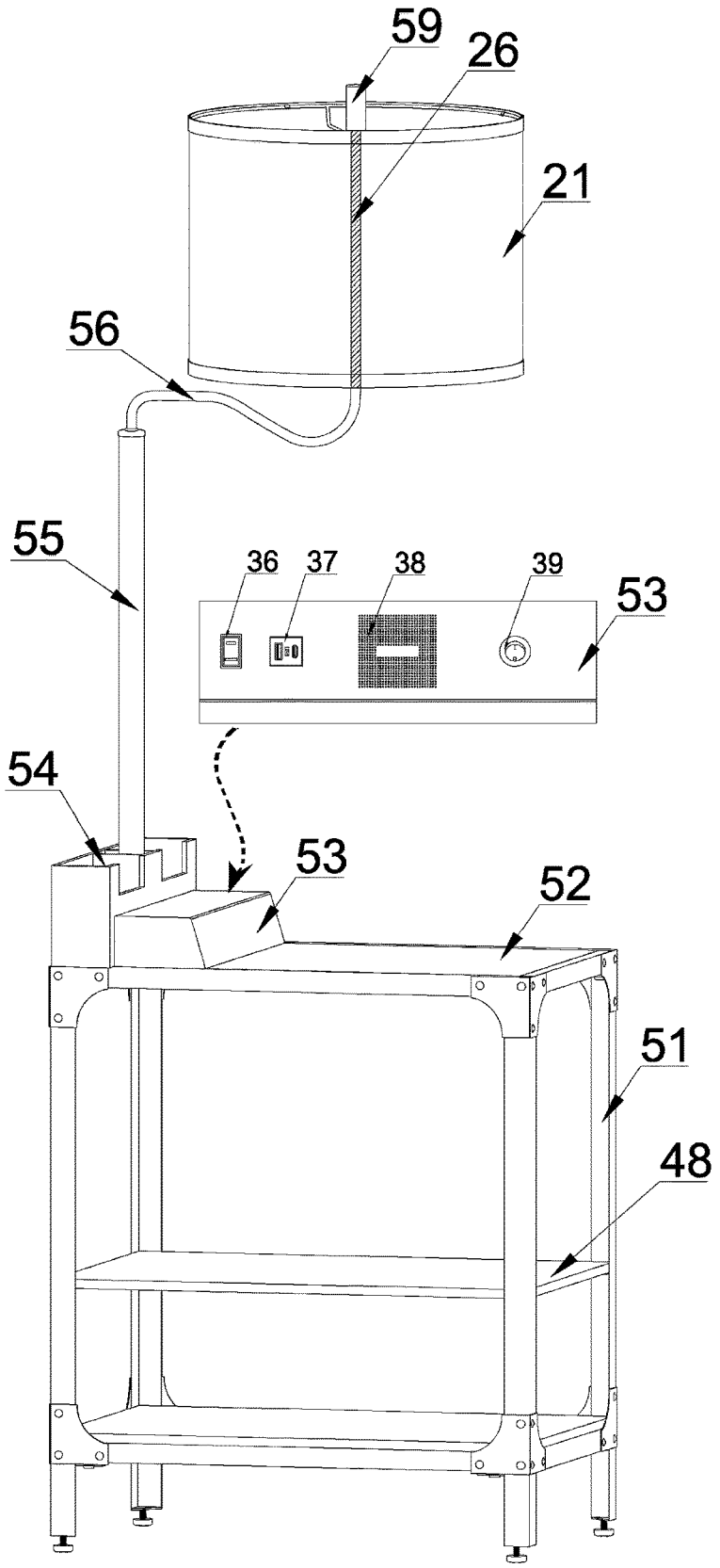
FIG. 10 is a three-dimensional schematic diagram of the embodiment of the present invention.
Figure 11:
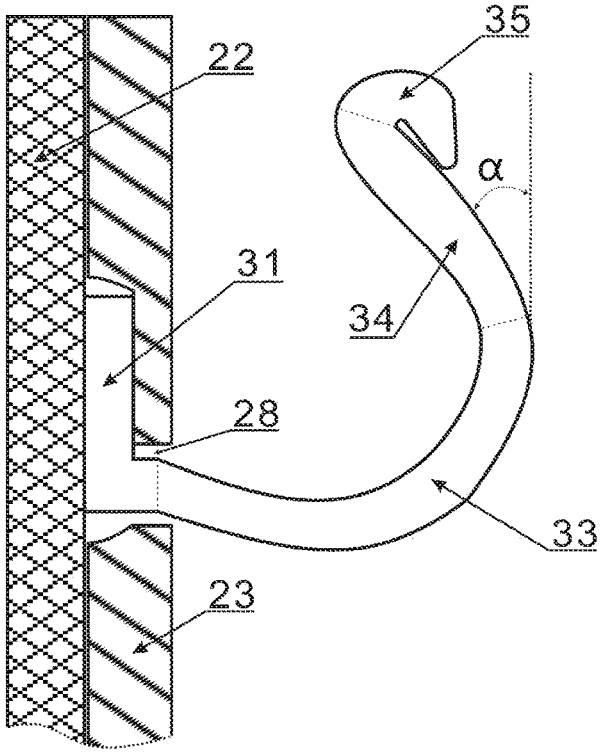
FIG. 11 is a schematic cross-sectional view of the hook part of the embodiment of the present invention.
Figure 12:
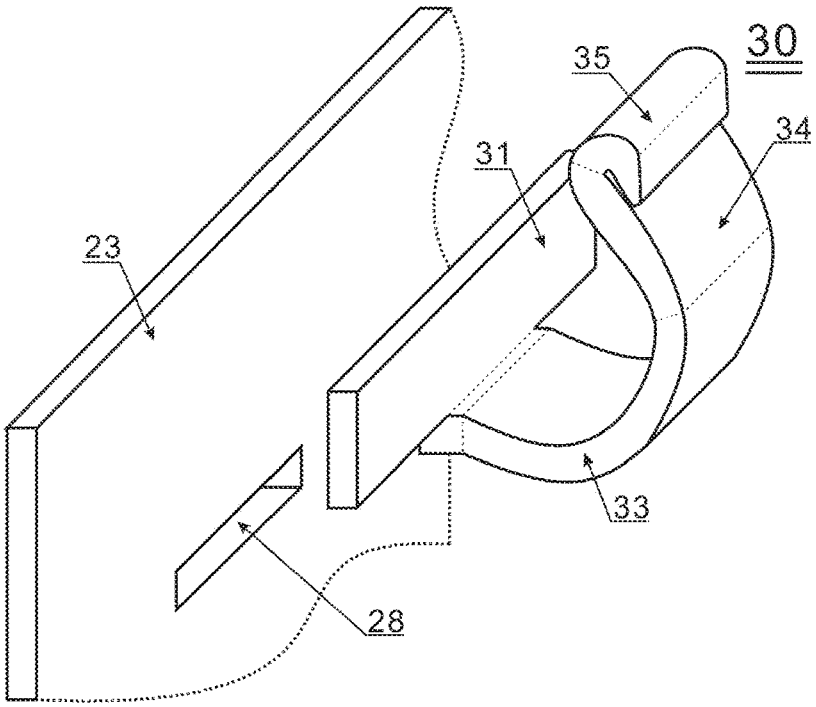
FIG. 12 is a schematic diagram of the hook part of the embodiment of the present invention.
Figure 13:
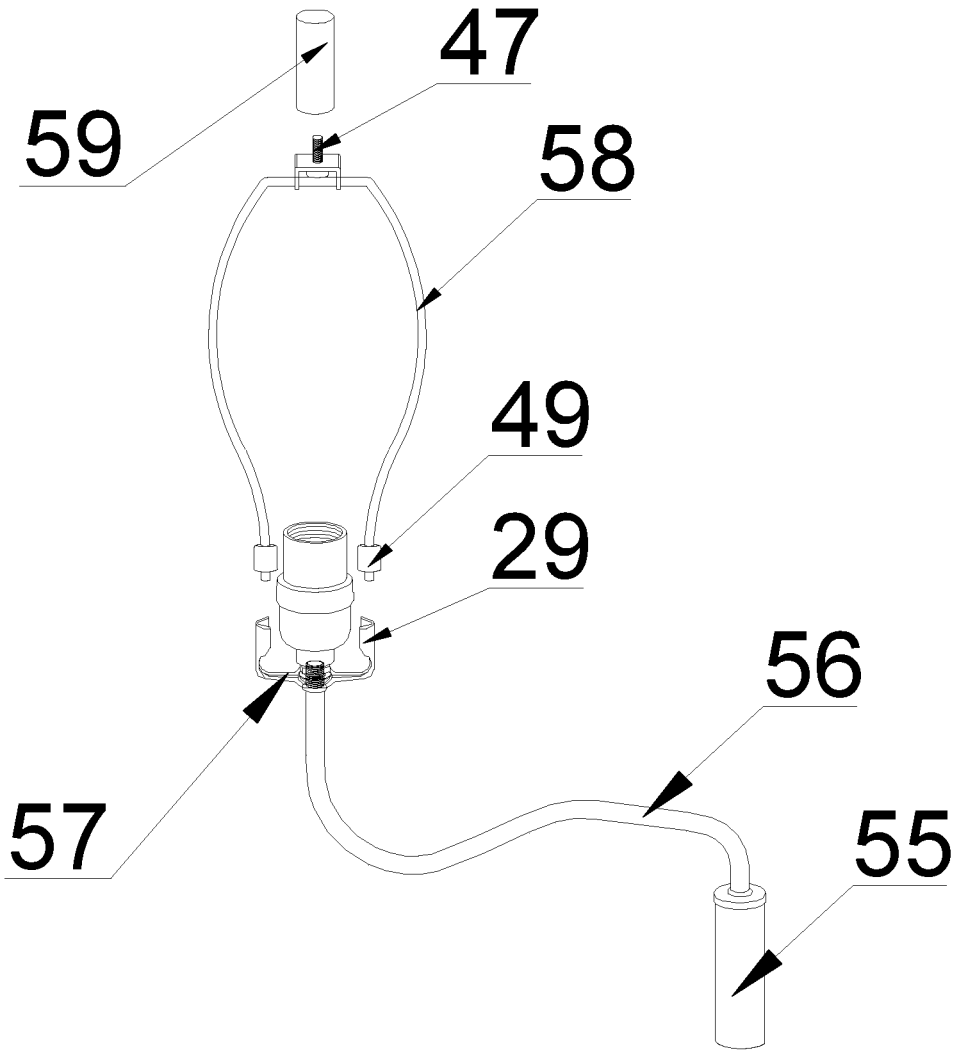
FIG. 13 is an exploded schematic diagram of the lampshade support part of the embodiment of the present invention.

The present invention further improves and optimizes the structure of the previous lampshade, and improves the stability and practicability of the structure. As shown in the drawings, the lampshade of the present invention comprises a cover body 21 and a plurality of hooks 30, which are respectively arranged on the inner sides of the upper and lower ends of the cover body 21. Each hook 30 comprises an inserting piece 31 and a spring arm 32. The inserting piece 31 is vertically arranged in the cover body 21, and the bottom end of the inserting piece 31 is provided with an inward extending spring arm 32. The width of the spring arm 32 is one third of that of the inserting piece 31, and the height of the inserting piece 31 is half of that of the spring arm 32. The spring arm 32 comprises an elastic section 33 (U-shaped), a collision section 34 and a circular arc end 35. The end of the circular arc end 35 is designed in an arc shape, with a smooth top for easy insertion.

The collision section 34 is inclined towards the upper direction of the elastic section 33 and extends higher than the top of the inserting piece 31. The opening of the hook 30 (the space between the inserting piece 31 and the circular arc end 35) faces the outer end of the cover body 21.

The cover body 21 comprises an outer cover layer 22 and an inner cover layer 23. The inserting piece 31 of the hook 30 is arranged between the outer cover layer 22 and the inner cover layer 23. The inner cover layer 23 is provided with a socket 28 which can accommodate the spring arm 32 of the hook 30 extending inward and penetrating the inner cover layer 23. The inserting piece 31 is fixed between the outer cover layer 22 and the inner cover layer 23 by viscose hot pressing. The included angle $\alpha$ of the projection of the inclined axis of the collision section 34 on the vertical plane of the inserting piece 31 is an acute angle.

In one embodiment, the upper support 10 and the lower support 20 are respectively arranged at the upper and lower ends of the cover body 21. The inner side of the top end of the cover body 21 is provided with a plurality of hooks 30 that can buckle the ring body of the upper support 10, the opening of the hook 30 on the inner side of the top end of the cover body 21 is upward, the collision section 34 of the hook 30 faces the inner wall of the cover body 21, and the ring of the extended upper support 10 is buckled in a plurality of hooks 30. The collision section 34 is close to the upper part of the ring of the upper support 10, so that the outer diameter of the ring of the upper support 10 (the combined ring body formed by the first upper arc ring 14 and the second upper arc ring 41 extending in a plane) collides with the inserting piece 31, the spring arm 32 hooks the ring, and the inserting piece 31 is forced together with the inner cover layer 23 to avoid the deformation of the inserting piece 31 in the cover body 21.

The inner side of the bottom end of the cover body 21 is provided with a plurality of hooks 30 that can buckle the ring body of the lower support 20, the opening of the hook 30 on the inner side of the bottom end of the cover body 21 is downward, and the ring of the extended lower support 20 is buckled in a plurality of hooks 30. The collision section 34 is close to the lower part of the ring of the lower support 20, so that the outer diameter of the ring of the lower support 20 (the combined ring body in which the lower arc ring 25 extends in a plane) collides with the inserting piece 31, and the spring arm 32 hooks the ring of the lower support 20.

In one embodiment, the included angle $\alpha$ of the projection of the inclined axis of the collision section 34 on the vertical plane of the inserting piece 31 is 20~35°, the better included angle $\alpha$ is 26°.

The lower support 20 comprises the second hinge 24 and the lower arc ring 25. The lower arc ring 25 is a semicircular arc ring, and the ends of the two lower arc rings 25 are connected through the second hinge 24. The lower support 20 is in a circle shape after extending in a plane.

The first support rod 11 and the second support rod 13 of the upper support 10 are fixedly welded on the first upper arc ring 14, and the center angle between the first support rod 11 and the second support rod 13 is 120 degrees. The inclination angle of the first support rod 11 and the second support rod 13 on the plane of the first upper arc ring 14 is an acute angle. The second connecting rod 17 and the first connecting rod 18 are longitudinally parallel to the plane of the first installation ring 12. An obtuse angle is formed between the first support rod 11 and the first connecting rod 18, and an obtuse angle is formed between the second support rod 13 and the second connecting rod 17.

In one embodiment, the upper support 10 is arranged on the top of the cover body 21 after turning into a plane. At this time, the first installation ring 12 and the second installation ring 46 are matched and arranged in parallel up and down. The planes of the first installation ring 12 and the second installation ring 46 are parallel to the plane of the circular upper support 10 (the plane of the upper support 10 in which the first upper arc ring 14 and the second upper arc ring 41 turn into a plane). The first installation ring 12 and the second installation ring 46 are coaxially arranged up and down to form the assembly ring of the upper support 10, the connecting part of the second connecting rod 17, the first connecting rod 18 and the first installation ring 12 is located between the first installation ring 12 and the second installation ring 46, and the connecting part of the fourth connecting rod 45 and the second installation ring 46 is located between the first installation ring 12 and the second installation ring 46. The surface of the non-connecting part between the first installation ring 12 and the second installation ring 46 is arranged outward.

A lamp comprises a support 51, on which a storage table 52 (Magazine Table) is arranged, and the lamp also comprises the lampshade described above. The end of the storage table 52 is provided with a storage box 54, and the side of the storage box 54 is flush with the side end of the storage table 52. The middle of the storage box 54 is provided with a support pipe 55, and the end of the support pipe 55 away from the storage box 54 is provided with a transversely extending telescopic rod 56, which is a curved and retractable support rod. The end of the telescopic rod 56 away from the support pipe 55 is provided with a vertical lamp holder 57, the lamp holder 57 is provided with a lampshade support 58, the lampshade support 58 extends upward, and the middle cavity of the lampshade support 58 can accommodate the lamp installed on the lamp holder 57.

A cover body 21 is arranged on the outside of the lamp holder 57 and the lampshade support 58. The screw 47 at the end of the lampshade support 58 away from the lamp holder 57 passes through the assembly ring in the middle of the upper support 10 of the cover body 21 (the combination of the first installation ring 12 and the second installation ring 46). The screw 47 is provided with an assembly head 59. The screw 47 at the top of the lamp holder 58 passing through the assembly ring of the upper support 10 is screwed and matched with the assembly head 59 (threaded connection), the assembly head 59 fixes the upper support 10 on the top of the lampshade support 58, and further fixes the cover body 21 on the outside of the lamp holder 57 and the lampshade support 58.

In one embodiment, the lamp holder 57 is provided with a group of symmetrical inward ring embracing buckle pieces 29, the lampshade support 58 is a strip-shaped elastic frame with two plug-in pins, the strip-shaped elastic frame of the lampshade support 58 is gourd-shaped, the top connecting section of the lampshade support 58 is provided with upward screws 47, and the ends of the two plug-in pins at the bottom of the lampshade support 58 are respectively provided with two buckle plugs 49 matching with the buckle pieces 29, and the buckle plugs 49 can be respectively clamped and located in the buckles 29.

A functional base 53 is arranged on the side of the storage box 54 facing the storage table 52, the functional base 53 is arranged on the storage table and close to the storage box 54, and the functional base 53 is provided with a socket 36, a USB kit 37 composed of a larger port and a smaller port, an audio 38 and a rocker switch 39. Install the audio 38 device on the functional base 53, so that the lamp integrates the functions of lighting, placing objects and playing music (supporting Bluetooth and answering calls on loudspeaker). The functional base 53 is equipped with two interfaces: a USB kit 37 composed of a larger and a smaller ports (USB/Type-C interface), which can provide mobile charging function.

A USB kit 37 composed of a larger port and a smaller port provides different charging interfaces, and the socket 36 can be selected to connect other power supply devices. A storage box 54 with three slots is designed on the storage table 52, which can hold various small objects such as pens and remote controls. The present invention reduces excessive landing devices, can effectively improve the space utilization rate, increase the aesthetics, users can charge the mobile phone while listening to music, is more practical and convenient, and the functions are more complete.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A lampshade, comprising a cover body and a plurality of hooks, which are respectively arranged on inner sides of upper and lower ends of the cover body; wherein the cover body is an elongated carrier sheet that is foldable, ends on both lateral sides of the cover body are provided with matching hook-and-loop fasteners, and the cover body is connected in a circle through the hook-and-loop fasteners at the ends on the both lateral sides;

each hook comprises an inserting piece and a spring arm, the inserting piece is vertically arranged in the cover body, and a bottom end of the inserting piece is provided with an inward extending spring arm; a width of the inserting piece is larger than a width of the spring arm, and a height of the spring arm is larger than a height of the inserting piece;

the spring arm comprises an elastic section, a collision section and a circular arc end;

an end of the spring arm connected to the inserting piece is provided with the elastic section, an end of the elastic section away from the inserting piece is connected to the collision section, and an end of the collision section away from the elastic section is provided with the circular arc end; the collision section is inclined towards an upper direction of the elastic section, and extends higher than a top of the inserting piece;

the cover body comprises an outer cover layer and an inner cover layer, the inserting piece of each hook is arranged between the outer cover layer and the inner cover layer, and the inner cover layer is provided with a socket which is able to accommodate the spring arm of each hook extending inward and penetrating the inner cover layer; an opening of each hook faces an outer end of the cover body;

a top of the cover body is provided with an upper support, and an upper support ring body is buckled in the plurality of hooks on the inner side of the top of the cover body; a bottom end of the cover body is provided with a lower support, and a lower support ring body is buckled in the plurality of hooks on the inner side of the bottom end of the cover body.

2. The lampshade according to claim 1, wherein the width of the spring arm is one third of the width of the inserting piece; the height of the inserting piece is half of the height of the spring arm; an included angle of a projection of an inclined axis of the collision section on a vertical plane of the inserting piece is an acute angle.

3. The lampshade according to claim 2, wherein the included angle of the projection of the inclined axis of the collision section on the vertical plane of the inserting piece is 20°~35°.

4. The lampshade according to claim 1, wherein the upper support comprises a first upper arc ring and a second upper arc ring, the first upper arc ring and the second upper arc ring are connected to each other through a first hinge, and the first upper arc ring and the second upper arc ring are in a circle shape after extending in a plane; the first upper arc ring is provided with a first support rod and a second support rod, and the first support rod and the second support rod are inclined downward.

5. The lampshade according to claim 4, wherein an end of the first support rod away from the first upper arc ring is provided with a first connecting rod, and an end of the second support rod away from the first upper arc ring is provided with a second connecting rod;

a first installation ring is arranged below the first upper arc ring, and a plane of the first installation ring is longitudinally parallel to a plane of the first upper arc ring; an end of the first connecting rod away from the first support rod is arranged on the first installation ring, and an end of the second connecting rod away from the second support rod is arranged on the first installation ring.

6. The lampshade according to claim 4, wherein a middle of the second upper arc ring is provided with a third support rod, an end of the third support rod away from the second upper arc ring is connected to a third connecting rod through a third hinge, and an end of the third connecting rod away from the third hinge is provided with a fourth connecting rod;

a second installation ring is arranged in the middle of the second upper arc ring, an end of the fourth connecting rod away from the third connecting rod is arranged on the second installation ring, and the fourth connecting rod is parallel to a plane of the second installation ring.

7. A lamp, comprising a support, on which a storage table is arranged, wherein the lamp further comprising the lampshade according to claim 1, an end of the storage table is provided with a storage box, an outside of the storage box is flush with a side end of the storage table, a middle of the storage box is provided with a support pipe, and an end of the support pipe away from the storage box is provided with a transversely extending telescopic rod, an end of the telescopic rod away from the support pipe is provided with a vertical lamp holder, the lamp holder is provided with a lampshade support, the lampshade support extends upward;

the cover body is arranged on an outside of the lamp holder and the lampshade support, a screw at an end of the lampshade support away from the lamp holder passes through an assembly ring in a middle of the upper support, and the screw is provided with an assembly head matched therewith.

8. The lamp according to claim 7, wherein the support is provided with a storage plate, which is located below the storage table;

the lamp holder is provided with a group of symmetrical inward ring embracing buckle pieces, the lampshade support is a strip-shaped elastic frame with two plug-in pins, the strip-shaped elastic frame of the lampshade support is gourd-shaped, a top connecting section of the lampshade support is provided with the screw facing upward, and ends of the two plug-in pins at a bottom of the lampshade support are respectively provided with buckle plugs matching with the buckle pieces, the buckle plugs are respectively buckled and located in the buckle pieces.

9. The lamp according to claim 7, wherein a functional base is arranged on a side of the storage box facing the storage table, the functional base is arranged adjacent to the storage box, and the functional base is provided with a socket, a USB kit including a larger port and a smaller port, an audio and a rocker switch.

* * * * *